US007823481B2

(12) United States Patent
Makino et al.

(10) Patent No.: US 7,823,481 B2
(45) Date of Patent: Nov. 2, 2010

(54) PEDAL MODULE

(75) Inventors: Masahiro Makino, Kariya (JP); Shigeru Hasegawa, Nagoya (JP); Takehiro Saito, Kariya (JP)

(73) Assignee: Denso Corporation, Kariya (JP)

( * ) Notice: Subject to any disclaimer, the term of this patent is extended or adjusted under 35 U.S.C. 154(b) by 1090 days.

(21) Appl. No.: 11/058,693

(22) Filed: Feb. 16, 2005

(65) Prior Publication Data

US 2005/0183535 A1 Aug. 25, 2005

(30) Foreign Application Priority Data

Feb. 20, 2004 (JP) ..... 2004-044460

(51) Int. Cl.
*G05G 1/30* (2008.04)

(52) U.S. Cl. ..... 74/512; 74/513

(58) Field of Classification Search ..... 74/512–514, 74/516, 518, 560; 324/207.25; 267/213, 267/179; 173/162.2; 702/188; 73/1.79
See application file for complete search history.

(56) References Cited

U.S. PATENT DOCUMENTS

| | | | | |
|---|---|---|---|---|
| 2,565,672 | A * | 8/1951 | Withall | 267/213 |
| 6,360,631 | B1 * | 3/2002 | Wortmann et al. | 74/513 |
| 6,658,963 | B2 * | 12/2003 | Yaddehige | 74/512 |
| 6,758,114 | B2 * | 7/2004 | Sundaresan et al. | 74/512 |
| 6,802,202 | B2 | 10/2004 | Kato et al. | |
| 7,012,423 | B2 * | 3/2006 | Hasegawa et al. | 324/207.25 |
| 7,228,758 | B2 * | 6/2007 | Fujiwara | 74/512 |
| 7,357,380 | B2 * | 4/2008 | Menzel et al. | 267/179 |
| 2002/0104665 | A1 * | 8/2002 | Wolf et al. | 173/162.2 |
| 2009/0071286 | A1 * | 3/2009 | Ueno et al. | 74/513 |

FOREIGN PATENT DOCUMENTS

| | | | |
|---|---|---|---|
| DE | 44 07 005 | C1 * | 3/1995 |
| DE | 195 00 569 | A1 * | 7/1996 |
| DE | 19517172 | * | 11/1996 |
| DE | 100 21 532 | A1 * | 11/2001 |
| EP | 0 923 015 | A2 * | 6/1999 |
| EP | 1 602 852 | A2 * | 12/2005 |

(Continued)

OTHER PUBLICATIONS

Derwent English Abstract # 2007-501919 of JP 2007-113525 (Pub. date May 10, 2007).*
English Abstract of DE 195 00 569 A1 (Pub. date Jul. 18, 1996).*
English Abstract of DE 44 07 005 C1 (Pub. date Mar. 9, 1995).*

(Continued)

*Primary Examiner*—Vinh T. Luong
(74) *Attorney, Agent, or Firm*—Nixon & Vanderhye PC

(57) ABSTRACT

A pedal module includes a double coil spring, a pedal, and a damping part. The double coil spring includes an outside coil and an inside coil. The pedal turns in a forward direction when a depressing force is applied thereto and turns in a reverse direction when a restoring force of the double coil spring is applied thereto. The damping part has an inserting portion disposed between the outside coil and the inside coil. The inserting portion includes a middle portion and a first side end portion disposed relative to each other in a width direction that corresponds to a circumferential direction of the double coil spring. The middle portion crosses a radial axis of the double coil spring and protrudes beyond the first side end portion toward an axial end of the double coil spring.

17 Claims, 13 Drawing Sheets

FOREIGN PATENT DOCUMENTS

| | | | |
|---|---|---|---|
| JP | A-H4-128519 | | 4/1992 |
| JP | 2001-109532 | * | 4/2001 |
| JP | 2002-114052 A | * | 4/2002 |
| JP | 2007-113525 | * | 5/2007 |
| JP | 2009-169812 | * | 7/2009 |

OTHER PUBLICATIONS

Machine translation of DE 4407005 (Berglar) from EPO.*

Japanese Office Action dated Nov. 14, 2008, issued in Japanese Application No. 2004-044460, with English translation.

* cited by examiner

PEDAL MODULE

CROSS REFERENCE TO RELATED APPLICATIONS

This application is based upon and claims the benefit of priority of Japanese Patent Application No. 2004-44460, filed on Feb. 20, 2004, the contents of which are incorporated herein by reference.

FIELD OF THE INVENTION

The present invention relates to a pedal module and, in particular, to a pedal module suitable for an accelerator for a vehicle.

BACKGROUND OF THE INVENTION

In a conventional pedal module used for an accelerator for a vehicle, a pedal is turned forward by the action of a depressing force and is reversed by the urging force of a spring. Among the modules like this is a publicly known module that reverses the pedal from a forward position by the use of a double coil spring, as disclosed in Japanese patent document JP-A No. 2003-39970 (corresponding to U.S. Pat. No. 6,802,202).

In recent years, it is thought that a damping part 100 as shown in FIG. 16 is arranged in the pedal module using a double coil spring. To be specific, the damping part 100 is formed in the shape of a rectangular flat plate and is bent in the shape of a letter U and a middle portion in the direction of length is retained by an inside coil 111 of a double coil spring 110. Both end portions in the direction of length in the damping part 100 are formed into inserting portions 101 inserted between the inside coil 111 and an outside coil 112 of the double coil spring 110, respectively. These inserting portions 101 can prevent the establishment of resonance of the inside coil 111 and the outside coil 112 with external vibration. Further, these inserting portions 101 secure the gaps between the inside coil 111 and the outside coil 112 and prevent these coils 111 and 112 from being put into contact with each other. Hence, the double coil spring 100 can deliver desired spring characteristics.

Here, as for the respective inserting portions 101 of the damping part 100 shown in FIG. 16, attention is paid to their side end portions 102 in such a direction of width thereof (or peripheral direction of spring) that crosses the radial axis 113 of the double coil spring 110. As shown in FIG. 17, when the double coil spring 110 is compressed, first, the side end portions 102 of the respective inserting portions 101 abut against the outside coil 112 in a gap 114 between windings of the outside coil 112. This is caused by the fact that the side end portions 102 of the respective inserting portions 101 are apt to enter the gap 114 between the windings of the outside coil 112 before the double coil spring 110 shown in FIG. 16 is compressed. When the double coil spring 110 is further compressed from a state where the side end portions 102 abut against the outside coil 112 in the gap 114 between the windings, the side end portions 102 are sprung and disengaged from the outside coil 112. Impact caused at this time produces abnormal noises and propagates to the pedal to impair feeling of depressing the pedal.

SUMMARY OF THE INVENTION

An object of the invention is to provide a pedal module for preventing the occurrence of abnormal noises and the deterioration of feeling of depressing a pedal.

In accordance with one aspect of the invention, in the inserting portion, a middle portion in such a direction of width that crosses an axis in the radial direction of the double coil spring is protruded toward one end of the double coil spring as compared with a side end portion in the direction of width. For this reason, the side end portion in the direction of width of the inserting portion is hard to enter a gap between windings of an outside coil and hence the side end portion in the direction of width is hard to abut against the outside coil in the gap between the windings of the outside coil when the double coil spring is compressed. Alternatively, even if the side end portion in the direction of width of the inserting portion enters the gap between the windings of the outside coil, when the double coil spring is compressed, a portion between the side end portion in the direction of width and such a middle portion in the direction of width that protrudes as compared with the side end portion in the inserting portion abuts against the outside coil, thereby being guided inside the outside coil. With this, the side end portion in the direction of width is hard to abut against the outside coil in the gap between the windings of the outside coil.

In this manner, the side end portion in the direction of width of the inserting portion is prevented from abutting against the outside coil in the gap between the windings of the outside coil. Hence, it is possible to avoid a problem that the side end portion is detached from the outside coil after the side end portion abuts against the outside coil to cause impact. Therefore, it is possible to prevent the occurrence of abnormal noises and the deterioration of feeling of depressing the pedal, which are caused when the damping part interferes with the outside coil.

According to another aspect of the present invention, an angle formed by the slant surface portion, which connects a side end portion in the direction of width to such a middle portion in the direction of width that is protruded as compared with the side end portion in the inserting portion, and an axis in the direction of width of the inserting portion is made larger than an angle formed by a material center line of the outside coil and the axis in the direction of width of the inserting portion. For this reason, it is possible to prevent the side end portion in the direction of width from abutting against the outside coil when the double coil spring is compressed. Therefore, it is possible to improve an effect of preventing the occurrence of abnormal noises and the deterioration of feeling of depressing the pedal.

In this regard, the slant surface portion that connects the side end portion in the direction of width in the inserting portion and the middle portion in the direction of width that is protruded as compared with the side end portion may be formed in the shape of a curved surface.

According to yet another aspect of the present invention, in the inserting portion, the middle portion in the direction of width is protruded toward the outside coil as compared with the side end portion in the direction of width. For this reason, the side end portion in the direction of width is hard to enter a gap between the windings of the outside coil. With this, when the double coil spring is compressed, it is possible to sufficiently prevent the side end portion in the direction of width from abutting against the outside coil in the gap between the windings of the outside coil. Therefore, it is possible to prevent the occurrence of abnormal noises and the deterioration of feeling of depressing the pedal.

According to yet another aspect of the present invention, in the inserting portion, a middle portion in such a direction of width that crosses an axis in the radial direction of the double coil spring and in such a direction of width that is not parallel to the center axis of the double coil spring is protruded toward the outside coil as compared with a side end portion in the direction of width. For this reason, the side end portion is hard to enter the gap between the windings of the outside coil. With this, when the double coil spring is compressed, the side end portion in the direction of width is hard to abut against the outside coil in the gap between the windings of the outside coil. Hence, it is possible to avoid a problem that the side end portion is detached from the outside coil after the side end portion abuts against the outside coil to cause impact. Therefore, it is possible to prevent the occurrence of abnormal noises and the deterioration of feeling of depressing the pedal, which are caused when the damping part interferes with the outside coil.

According to yet another aspect of the present invention, a damping part is adopted which is constructed of two inserting portion facing each other across the inside coil and a retaining portion that connects the two inserting portions and is retained by the inside coil in a gap between windings of the inside coil. With this, it is possible to facilitate a work of arranging the two inserting portions and to improve an effect of preventing resonance with external vibration.

In the accelerator for a vehicle, there are cases where a double coil spring is used in order to increase an urging force applied to its accelerator pedal.

Another aspect of the present invention is used as an accelerator for a vehicle in which the pedal is an accelerator pedal. Hence, it is possible to increase an urging force applied to the accelerator pedal and to prevent the occurrence of abnormal noises and the deterioration of feeling of depressing the pedal which are caused by the damping part. Therefore, the invention is suitable for an accelerator for a vehicle.

Other features and advantages of the present invention will be appreciated, as well as methods of operation and the function of the related parts from a study of the following detailed description, appended claims, and drawings, all of which form a part of this application. In the drawings:

DETAILED DESCRIPTION OF THE PREFERRED EMBODIMENTS

A plurality of preferred embodiments of the invention will now be described with reference to the drawings.

Figure 2:
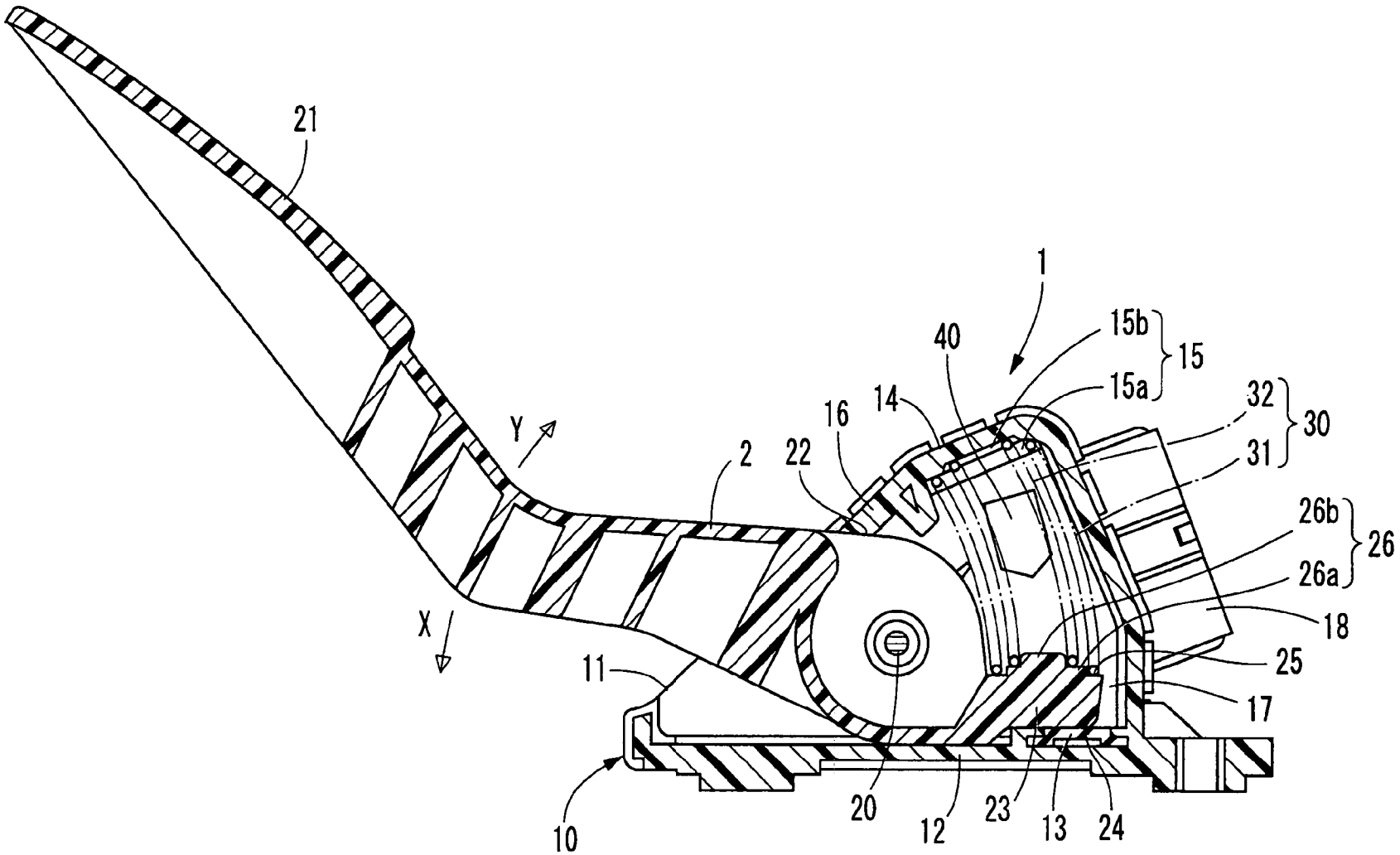
FIG. 2 is a cross-sectional side view of an accelerator for a vehicle in accordance with the first embodiment of the present invention.

An accelerator 1 for a vehicle as a pedal module in accordance with the first embodiment of the invention is shown in FIG. 2. The accelerator 1 for a vehicle as a pedal module in accordance with the first embodiment controls the driving state of the vehicle in response to a driver's operation of an accelerator pedal 2. The accelerator 1 adopts an accelerator-by-wire system and the accelerator pedal 2 is not mechanically coupled to the throttle unit of the vehicle. Instead, the accelerator 1 detects a turn angle of the accelerator pedal 2 with a turn angle sensor (not shown) and outputs a signal to indicate its detection result to an electronic control unit (ECU) of a vehicle engine. With this, the ECU controls the throttle unit on the basis of the turn angle of the accelerator pedal 2 derived from the output signal of the turn angle sensor.

A housing 10 supporting the accelerator pedal 2 is formed of resin in the shape of a box having an opening 11. The bottom plate 12 of housing 10 is fixed to the vehicle by bolts or a similar fastening means. A first stopper 13 formed of elastic material such as rubber is fixed to an inner wall of the bottom plate 12. A fixing hole 15 shaped like a stepped circular cylinder, the diameter of which becomes smaller as its depth becomes larger, is formed in an inner wall of a top plate 14 facing the bottom plate 12 in the housing 10. A second stopper 16 is formed integrally with an edge portion forming the opening 11 in the top plate 14. A turn angle sensor (not shown) for detecting the turn angle of the accelerator pedal 2 is fixed to a side plate 17 in the housing 10 and a connector part 18 for electrically connecting the turn angle sensor to the ECU is provided on the outer wall of the side plate 17.

The accelerator pedal 2 is formed of resin and is extended in the shape of a letter V. One end in the direction of length of the accelerator pedal 2 is received in the housing 10 and the other end in the direction of length is extended through the opening 11 to the outside of the housing 10. The accelerator pedal 2 has a turning shaft 20 in a middle portion in the direction of length that is received in the housing 10. The turning shaft 20 is supported by the side plate 17 of the housing 10 and is arranged in such a way as to be freely rotated around its axis. For purposes of this description, a reference symbol X in FIG. 2 denotes a forward rotational side of the accelerator pedal 2 and Y denotes a reverse rotational side of the accelerator pedal 2.

The accelerator pedal 2 has a depressing portion 21 at an end portion on a side extending from the housing 10. A driver depresses the depressing portion 21 to apply a depressing force to the depressing portion 21 for turning the accelerator pedal 2 forward.

The accelerator pedal 2 has an abutting portion 22 at a position between the turning shaft 20 and the depressing portion 21 in the direction of length thereof. The abutting portion 22 can abut against the second stopper 16.

The accelerator pedal 2 has a plate-shaped retaining portion 23 at an end portion on a side received in the housing 10. In the retaining portion 23, one plate surface 24 faces the bottom plate 12 and the other plate surface 25 faces the top plate 14. The plate surface 24 of the retaining portion 23 can abut against the first stopper 13. The retaining portion 23 has an integral protruding portion 26 protruding from the plate surface 25 toward the top plate 14. The protruding portion 26 is formed in the shape of a stepped circular column, the diameter of which becomes smaller as the position becomes closer to its protruding end side.

A double coil spring 30 is interposed between the top plate 14 and the retaining portion 23. The double coil spring 30 is constructed of a combination of two cylindrical compression springs having predetermined uniform diameters. In the double coil spring 30, an outside coil 31 has a larger diameter than an inside coil 32 and is wound in a direction opposite to the inside coil 32 and is coaxially arranged outside the inside coil 32. One end of the outside coil 31 is fixed to a large diameter portion 15*a* of the fixing hole 15 and the other end of the outside coil 31 is retained by a large diameter portion 26*a* of the protruding portion 26. One end of the inside coil 32 is fixed to a small diameter portion 15*b* of the fixing hole 15 and the other end of the outside coil 32 is retained by a small diameter portion 26*b* of the protruding portion 26. The outside coil 31 and the inside coil 32 produce a restoring force when they are axially compressed between the top plate 14 and the retaining portion 23. Further, in this embodiment, the outside coil 31 and the inside coil 32 are curved away from the turning shaft 20 to produce a supplemental restoring force. Hence, the double coil spring 30 applies a resultant force of the restoring forces, which are respectively produced by the outside coil 31 and the inside coil 32, as an urging force to the retaining portion 23. At this time, the urging force is applied to the retaining portion 23 in such a way as to turn the accelerator pedal 2 in the reverse direction.

In this manner, when the depressing force is applied to the depressing portion 21 of the accelerator pedal 2 to separate the retaining portion 23 and the abutting portion 22 from the first stopper 13 and the second stopper 16, respectively, the accelerator pedal 2 is allowed to be turned in forward and reverse directions. At this time, the double coil spring 30 is compressed in the axial direction in response to the turn angle of the accelerator pedal 2. In contrast to this, when the retaining portion 23 and the abutting portion 22 of the accelerator pedal 2 are turned in the reverse direction by the urging force of the double coil spring 30 to abut against the first stopper 13 and the second stopper 16, respectively, the accelerator pedal 2 is prohibited from being turned further in the reverse direction. At this time, the double coil spring 30 is brought into a state where it is most elongated in the axial direction.

A damping part 40 is attached to the double coil spring 30. The damping part 40 will be described below in detail.

Figure 3:
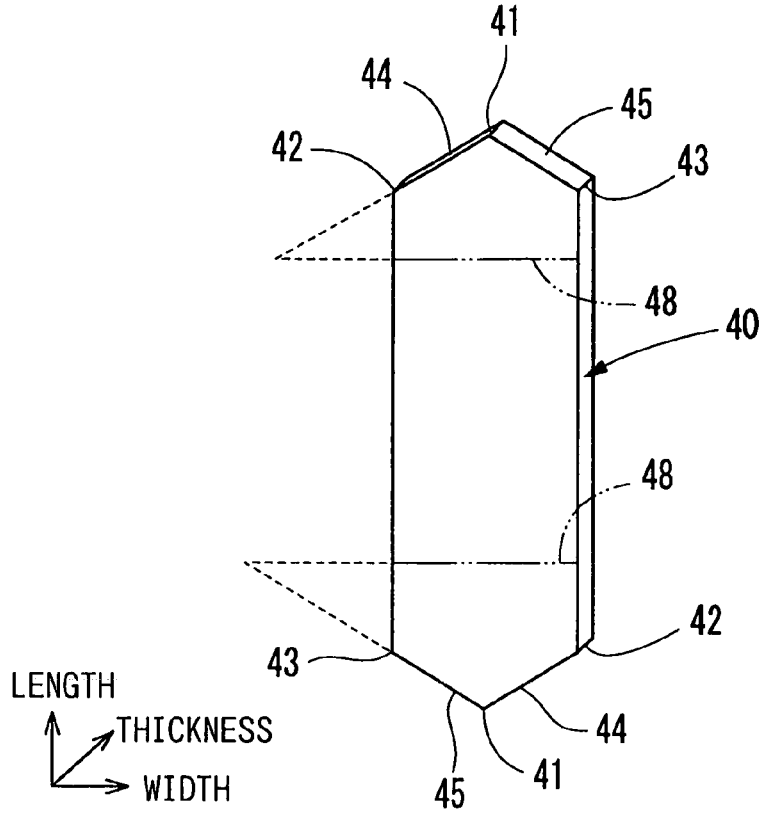
FIG. 3 is a perspective view of the damping part of FIG. 1.

FIG. 3 shows a state where the damping part 40 is detached from the double coil spring 30. First, the damping part 40 in this state will be described. The damping part 40 is formed of elastic material such as rubber in the shape of a long flat plate. In each of both end portions in the direction of length of the damping part 40, a middle portion 41 in the direction of width is protruded outside in the direction of length from the side end portions 42, 43 on both sides in the direction of width and is pointed in an angular shape. Further, in each of both of the end portions, slant surface portions 44, 45, which respectively connect the middle portion 41 in the direction of width to side end portions 42, 43 in the direction of width and slant with respect to an axis 48 in the direction of width, are formed respectively in the shape of a flat surface, whereby the damping part 40 is formed in a hexagon when viewed from the direction of thickness. The thickness of the damping part 40 is nearly constant in the direction of length and in the direction of width.

Figure 1A:
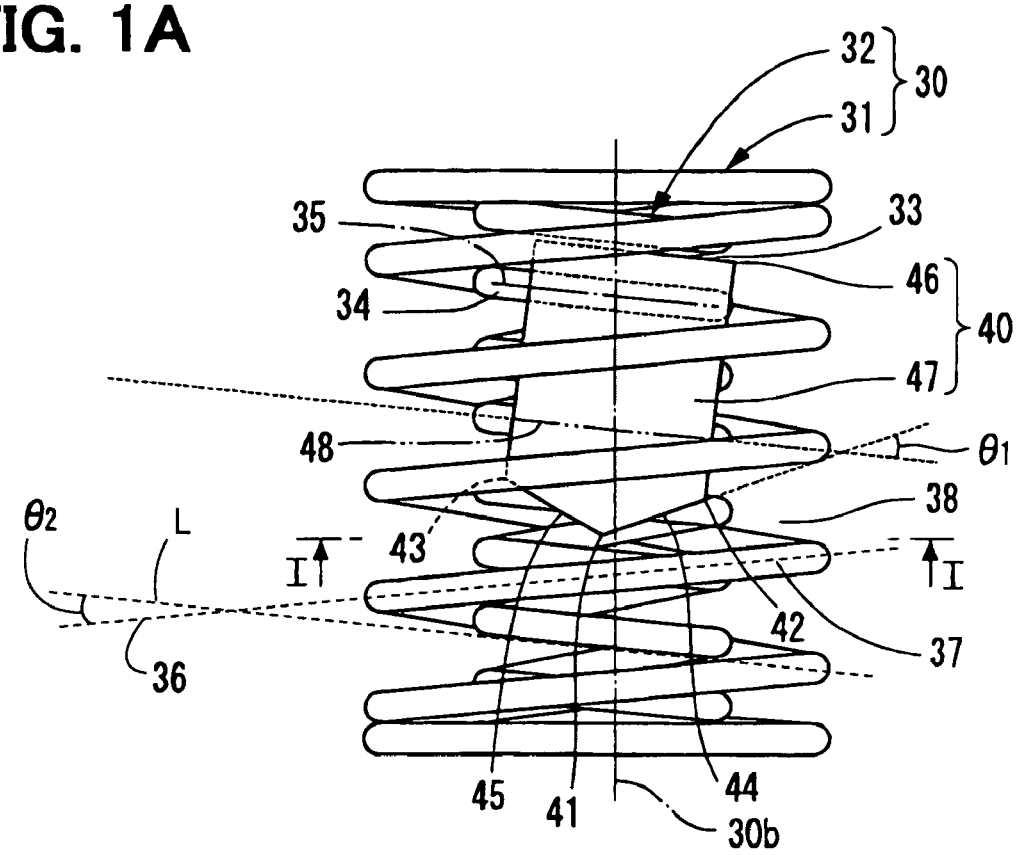
FIG. 1A is a partially hidden front view of a damping part in accordance with a first embodiment of the present invention is attached to a double coil spring.

FIG. 1 shows a state where the damping part 40 is attached to the double coil spring 30. Next, the damping part 40 in this state will be described. The damping part 40 is bent at two positions in the direction of length along the direction of width in such a way as to be formed into the shape of a letter U when viewed from the direction of width. In the damping part 40, a middle portion in the direction of length which forms a bottom portion of a shape like a letter U forms a retaining portion 46 retained by a wiring 34 of the inside coil 32 in a gap 33 between the windings of the inside coil 32. In the damping part 40, both end portions in the direction of length, each of which forms a side portion of the shape like a letter U, form inserting portions 47 inserted between the outside coil 31 and the inside coil 32, respectively. In this manner, the damping part 40 is formed in which the retaining portion 46 connects the respective inserting portions 47 facing each other across the inside coil 32.

Figure 1B:
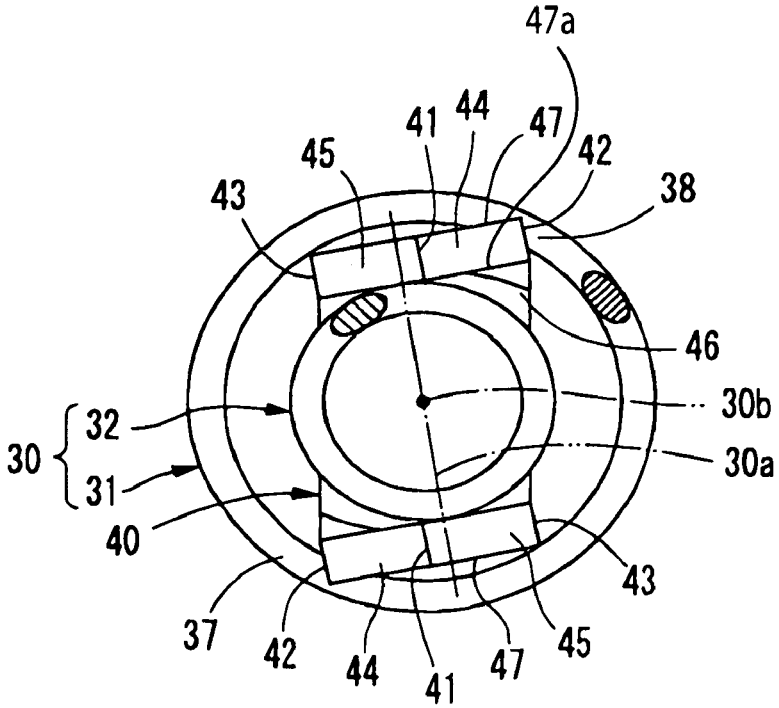
FIG. 1B is a cross-sectional view taken through line I-I of FIG. 1A.

In the damping part 40 attached to the double coil spring 30 in the above-described manner, the direction of width of the respective inserting portions 47 becomes a direction that crosses the radial axis 30*a* of the double coil spring 30 and is not parallel to the center axis 30*b* of the double coil spring 30, in particular, in this embodiment, a direction along the material center line 35 of the inside coil 32. In each of the inserting portions 47, the middle portion 41 in the direction of width is formed in a shape protruding toward the same one end of the double coil spring 30 from the side end portions 42, 43 on both sides in the direction of width. Further, in each of the inserting portions 47, an angle $\theta_1$ formed by the slant surface portion 44 (45) and the axis 48 in the direction of width is larger than an angle $\theta_2$ formed by the material centerline 36 of the outside coil 31 and a line L parallel to the axis 48. Here, in this embodiment, the angle $\theta_2$ is nearly equal to the sum of pitch angles of the outside coil 31 and the inside coil 32 which are wound in reverse directions with respect to each other. Further, each of the inserting portions 47 has a flat, planar radially inner surface 47*a* that is tangentially disposed with respect to the inside coil 32, the radial direction of the outside coil 31 is substantially perpendicular to the flat, planar radially inner surface 47*a* of the damping part 40 as shown in FIG. 1B.

In the state where the double coil spring 30 is elongated most as shown in FIG. 1, of the side end portions 42, 43 of the respective inserting portions 47, the side end portion 42 closer to the wiring 37 of the outside coil 31 located on the protruding side of the middle portion 41 is apt to enter a gap 38 between the windings of the outside coil 31.

Figure 4A:
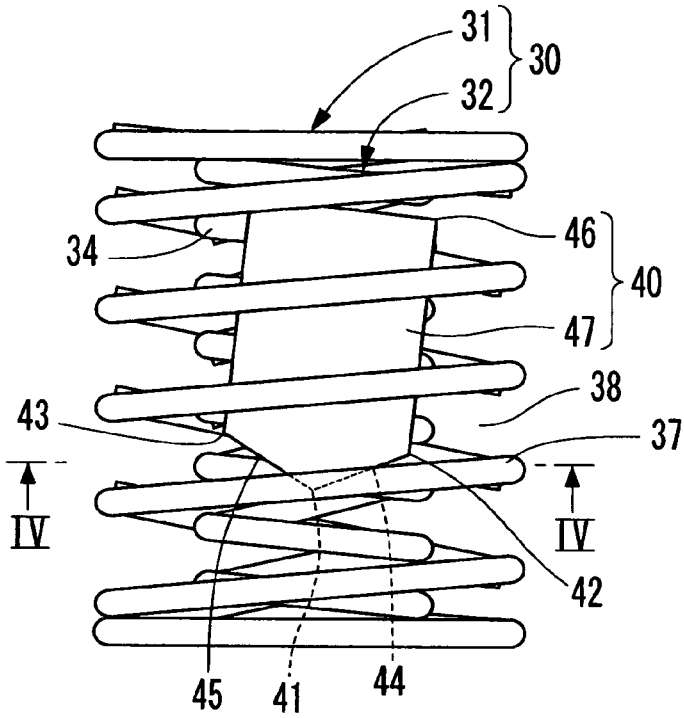
FIG. 4A is a front view of the damping part of FIG. 1 for illustrating its operation.
Figure 4B:
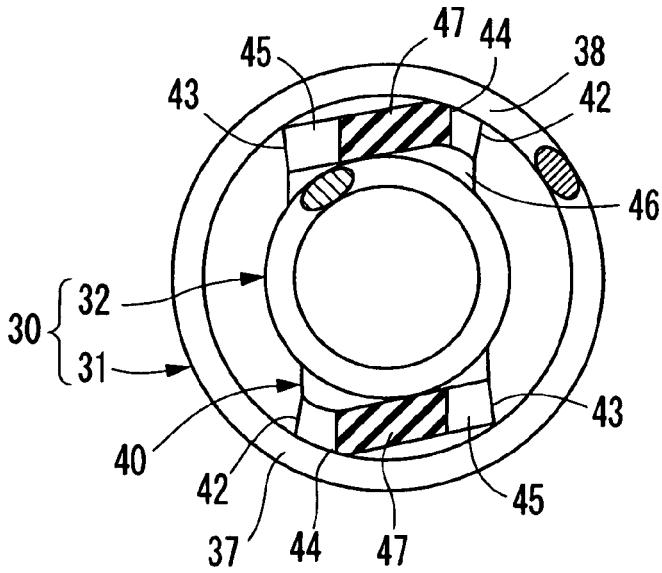
FIG. 4B is a cross-sectional view taken through line IV-IV in FIG. 4A.

When the double coil spring 30 is compressed from a state shown in FIG. 1, as shown in FIG. 4, the middle portions 41 of the respective inserting portions 47 do not abut against the outside coil 31 but pass through between the outside coil 31 and the inside coil 32. For this reason, in the respective inserting portions 47, first, the slant surface portions 44 each connecting the side end portion 42 to the middle portion 41 abut against the wiring 37 of the outside coil 31. When the double coil spring 30 is further compressed after the slant surface portions 44 abut against the wiring 37, the slant surface portions 44 of the respective inserting portions 47 are guided inside the wiring 37 of the outside coil 37 by the wiring 37. For this reason, the side end portions 42 of the respective inserting portions 47 are hard to abut against the outside coil 31 in the gap 38 between the windings. In particular, in this embodiment, the slant surface portion 44 of each of the inserting portions 47 increases the effect of preventing the side end portions 42 of the respective inserting portion 47 from abutting against the outside coil 31 because the angle $\theta_1$ formed by the slant surface portion 44 and the axis 48 in the direction of width is larger than the angle $\theta_2$ formed by the material center line 36 of the outside coil 31 and the axis 48 in the direction of width.

According to the first embodiment described above, it is possible to prevent the side end portions 42 in the direction of width of the respective inserting portions 47 from abutting against the outside coil 31 in the gap 38 between the windings and further to prevent the side end portions 42 from detaching from the outside coil after abutting to cause impact. Hence, it is possible to prevent the occurrence of abnormal noises and the deterioration of feeling of depressing the accelerator pedal as in the case of the conventional accelerator pedal.

Further, according to the first embodiment, because two inserting portions 47 are inserted between the outside coil 31 and the inside coil 32, it is possible to prevent the occurrence of abnormal noises and the deterioration of feeling of depressing the accelerator pedal and at the same time to improve an effect of preventing resonance with external vibration. In addition, since the damping part 40 having two inserting portions 47 like this is formed of a single part, the respective inserting portions 47 can be arranged with ease.

Figure 5:
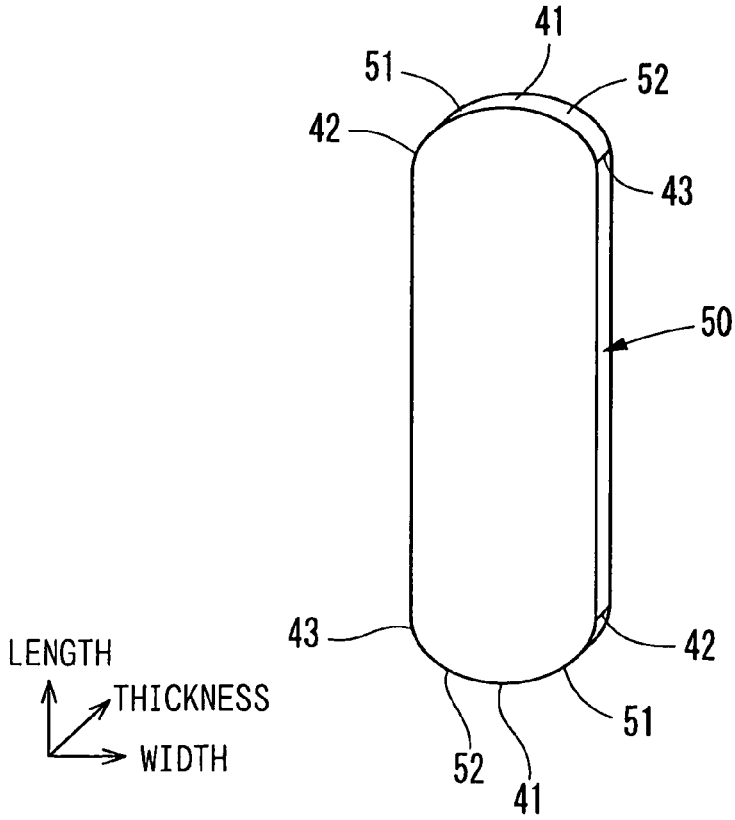
FIG. 5 is a perspective view of a damping part in accordance with a second embodiment of the present invention.

A second embodiment of the present invention is a modification of the first embodiment and FIG. 5 shows a state where a damping part 50 in accordance with the second embodiment is detached from the double coil spring 30. Slant surface portions 51, 52, each of which connects the middle portion 41 in the direction of width to the side end portions 42, 43 in the both side end portions in the direction of length of the damping part 50, are formed respectively in the shape of a curved surface protruding toward the outer periphery. Also the damping part 50 like this can be bent in the shape of a letter U as is the case with the first embodiment and can be attached to the double coil spring 30 to produce the same operation as in the first embodiment. Hence, it is possible to prevent the occurrence of abnormal noises and the deterioration of feeling of depressing the accelerator pedal.

Figure 6:
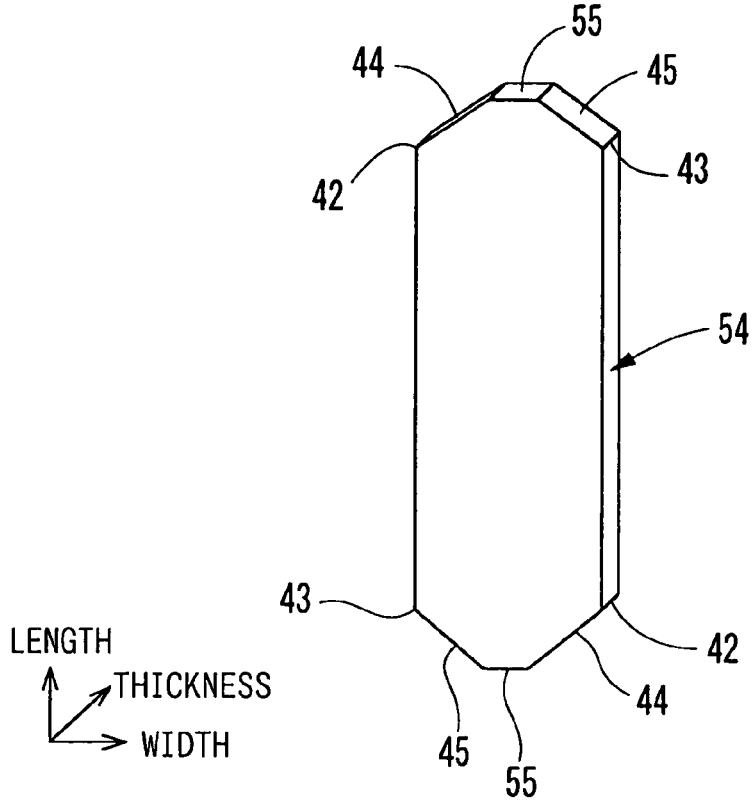
FIG. 6 is a perspective view of a damping part in accordance with a third embodiment of the present invention.

The third embodiment of the invention is a modification of the first embodiment and FIG. 6 shows a state where a damping part 54 in accordance with the third embodiment is detached from the double coil spring 30. Each of middle portions 55 in the direction of width in both end portions in the direction of length of the damping part 54 is protruded outside in the direction of length from the side end portions 42, 43 in the direction of width and is not pointed in the angular shape but formed in a flat surface. The slant surface portions 44, 45, each of which is formed in the shape of a flat surface and connects the middle portion 55 in the direction of width to the side end portions 42, 43 in the direction of width, are formed in both end portions in the direction of length of the damping part 54. In this manner, the damping part 54 is formed in an octagon when viewed from the direction of its thickness. Also the damping part 50 like this can be bent in the shape of a letter U as is the case with the first embodiment and can be attached to the double coil spring 30 to produce the same operation as in the first embodiment. Hence, it is possible to prevent the occurrence of abnormal noises and the deterioration of feeling of depressing the accelerator pedal.

Figure 7:
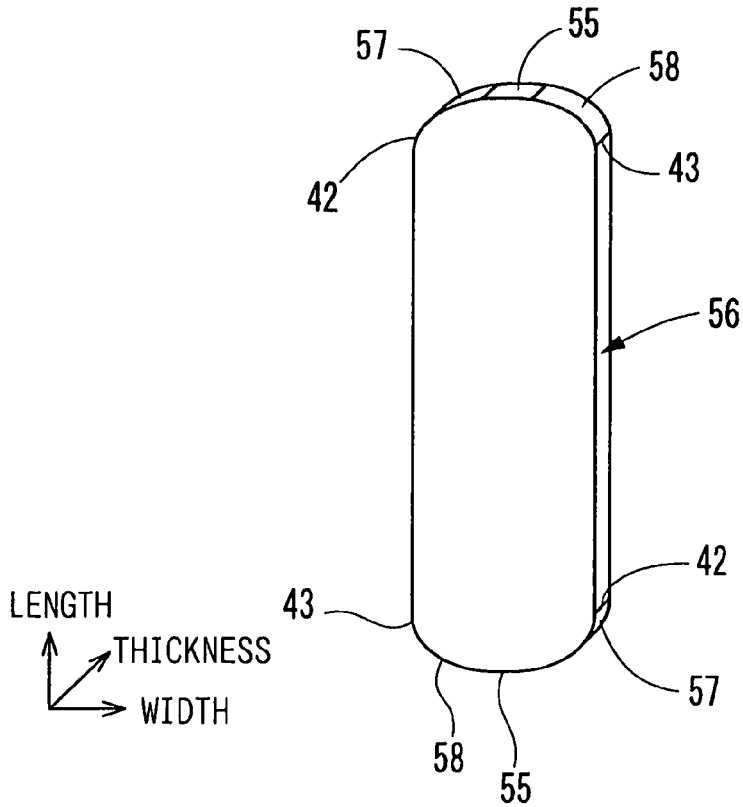
FIG. 7 is a perspective view of a damping part in accordance with a fourth embodiment of the present invention.

The fourth embodiment of the invention is a modification of the third embodiment and FIG. 7 shows a state where a damping part 56 in accordance with the fourth embodiment is detached from the double coil spring 30. Each of slant surface portions 57, 58, which respectively connect the middle portion 55 in the direction of width to the side end portions 42, 43 in the both side end portions in the direction of length of the damping part 50, are formed respectively in the shape of a curved surface protruding toward the outer periphery. Also the damping part 56 like this can be bent in the shape of a letter U as is the case with the first embodiment and can be attached to the double coil spring 30 to produce the same operation as in the first embodiment. Hence, it is possible to prevent the occurrence of abnormal noises and the deterioration of feeling of depressing the accelerator pedal.

Figure 8:
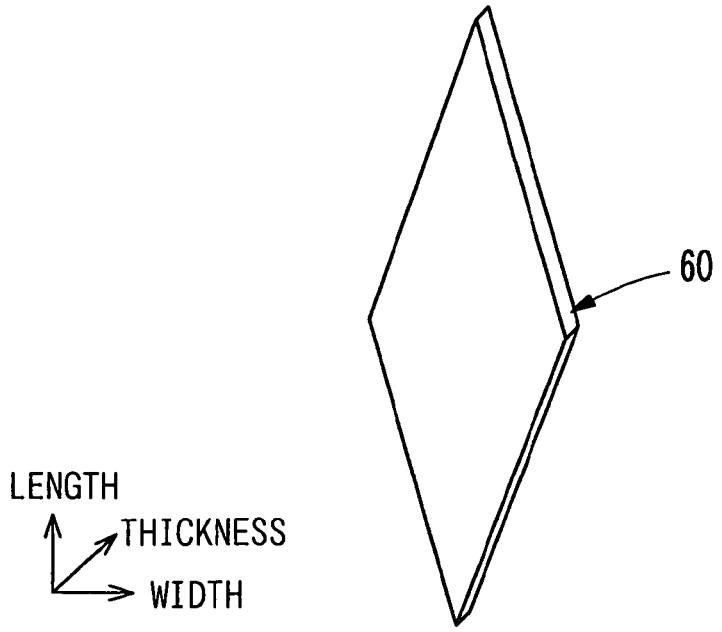
FIG. 8 is a perspective view of a damping part in accordance with a fifth embodiment of the present invention.

The fifth embodiment of the invention is a modification of the first embodiment and FIG. 8 shows a state where a damping part 60 in accordance with the fifth embodiment is detached from the double coil spring 30. The damping part 60 when viewed from the direction of its thickness is formed in the shape of a rhombus in which width decreases continuously from the center of the damping part 60 to both ends in the direction of length.

Figure 9A:
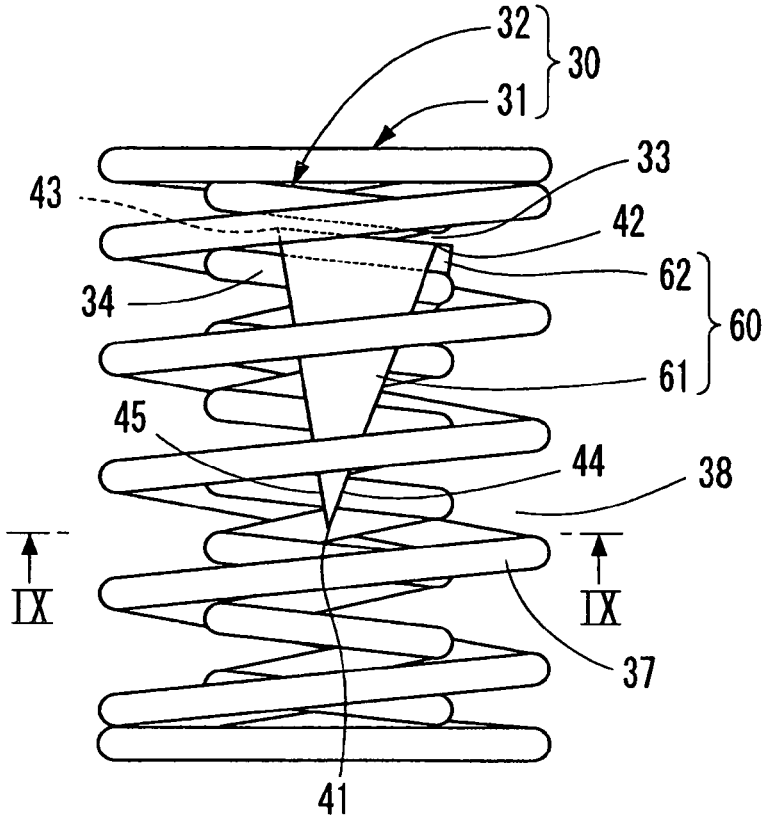
FIG. 9A is a front view of the damping part of the fifth embodiment attached to a double coil spring.
Figure 9B:
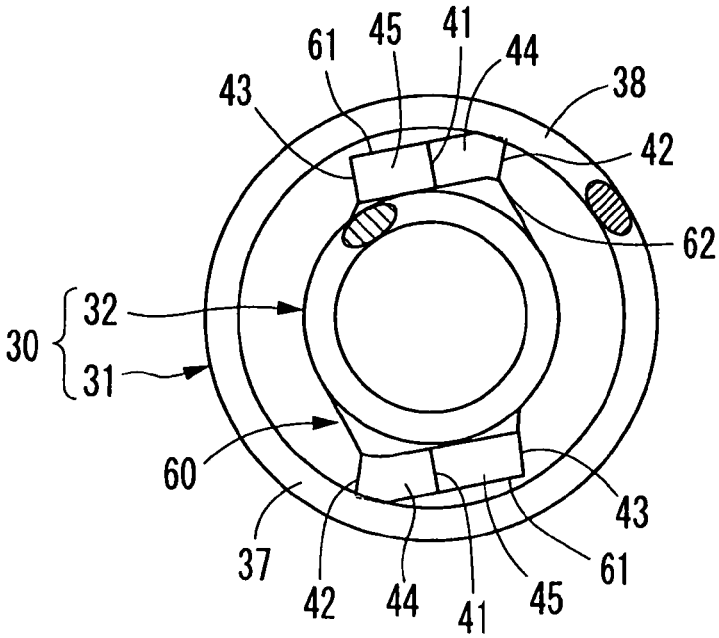
FIG. 9B is a cross-sectional view taken through line IX-IX of FIG. 9A.

When the damping part 60 like this is bent in the shape of a letter U as is the case with the first embodiment and is attached to the double coil spring 30, there is provided a state shown in FIG. 9. To be specific, in each of two inserting portions 61 constructed of both end portions in the direction of length of the damping part 60, a middle portion 41 in the direction of width is formed at an extreme tip pointed in an angular shape and side end portions 42, 43 in the direction of width are formed at the boundary between itself and a retaining portion 62 formed of the middle portion of the damping part 60. With this, in each of the inserting portions 61, the middle portion 41 in the direction of width is protruded toward the same one end of the double coil spring 30 as compared with the side end portions 42, 43 on both sides in the direction of width and slant surface portions 44, 45, each formed in a flat surface, connect the middle portion 41 to the side end portions 42, 43.

As described above, in the state shown in FIG. 9 where the double coil spring 30 is most elongated, the side end portion 42 of each inserting portion 61 is hard to enter a gap 38 between the windings of the outside coil 31. This prevents the side end portion 42 of each inserting portion 61 from abutting against the outside coil 31 in the gap 38 between the windings when the double coil spring 30 is compressed and to prevent the side end portion 42 from detaching from the outside coil 31 to cause impact. Hence, it is possible to prevent the occurrence of abnormal noises and the deterioration of feeling of depressing the accelerator pedal.

Figure 10:
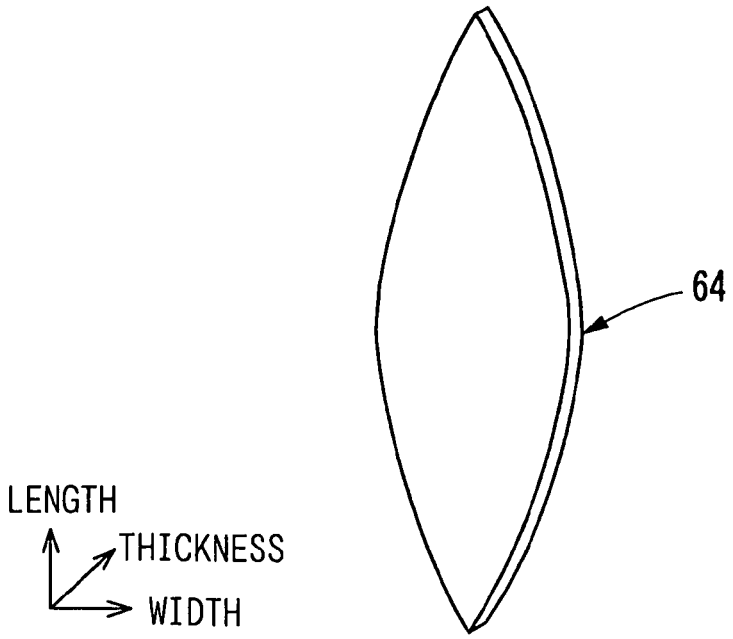
FIG. 10 is a perspective view of a damping part in accordance with a sixth embodiment of the present invention.

The sixth embodiment of the invention is a modification of the second embodiment and FIG. 10 shows a state where a damping part 64 in accordance with the sixth embodiment is detached from the double coil spring 30. The damping part 64 when viewed from the direction of its thickness is formed in the shape of a spindle in which width decreases continuously from the center of the damping part 64 to the both ends in the direction of length.

Figure 11A:
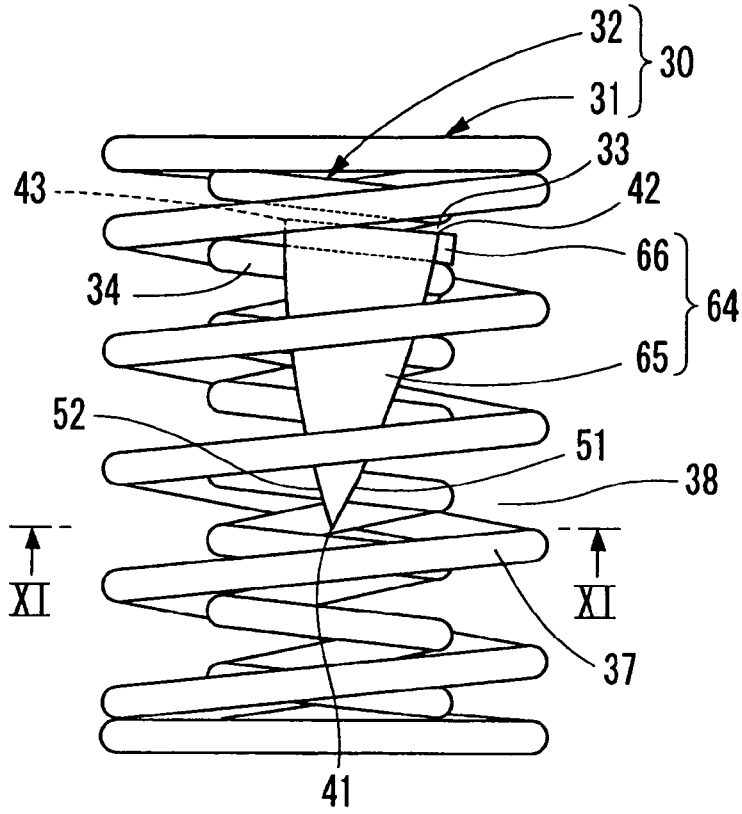
FIG. 11A is a front view of the damping part of the sixth embodiment attached to a double coil spring.
Figure 11B:
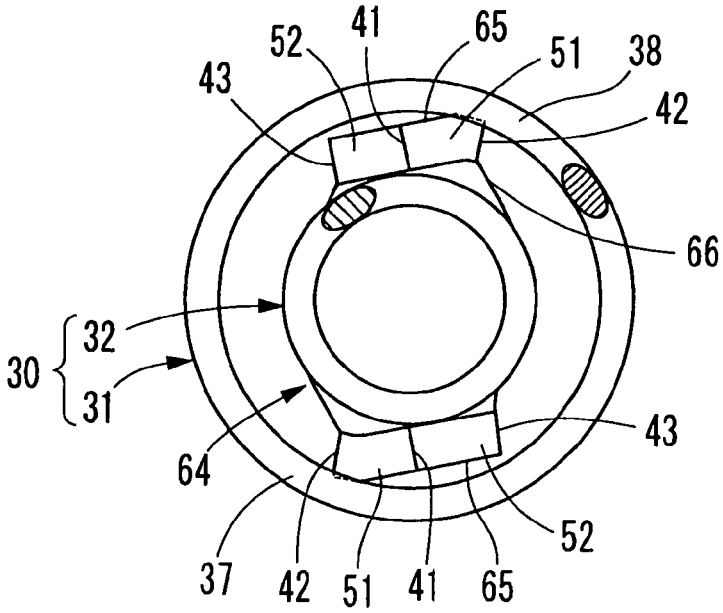
FIG. 11B is a cross-sectional view taken through line XI-XI of FIG. 11A.

When the damping part 64 like this is bent in the shape of a letter U as is the case with the first embodiment and is attached to the double coil spring 30, there is provided a state shown in FIG. 11. To be specific, in each of two inserting portions 65 constructed of both end portions in the direction of length of the damping part 60, a middle portion 41 in the direction of width is formed at an extreme tip pointed in an angular shape and side end portions 42, 43 in the direction of width are formed at the boundary between itself and a retaining portion 66 formed of the middle portion of the damping part 64. With this, in each of the inserting portions 65, the middle portion 41 in the direction of width is protruded toward the same one end of the double coil spring 30 as compared with the side end portions 42, 43 on both sides in the direction of width and slant surface portions 51, 52 each formed in the shape of a curved surface connect the middle portion 41 to the side end portions 42, 43.

As described above, in the state shown in FIG. 11 where the double coil spring 30 is most elongated, the side end portion 42 of each inserting portion 65 is hard to enter a gap 38 between the windings of the outside coil 31. This prevents the side end portion 42 of each inserting portion 65 from abutting against the outside coil 31 in the gap 38 between the windings when the double coil spring 30 is compressed and to prevent the side end portion 42 from detaching from the outside coil 31 to cause impact. Hence, it is possible to prevent the occurrence of abnormal noises and the deterioration of feeling of depressing the accelerator pedal.

Figure 12:
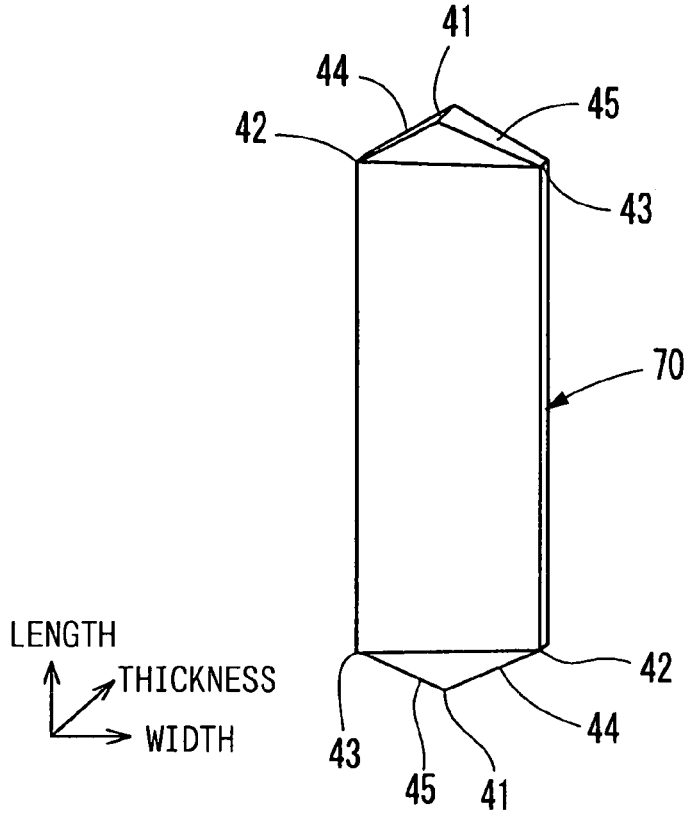
FIG. 12 is a perspective view of a damping part in accordance with a seventh embodiment of the present invention.

The seventh embodiment of the invention is a modification of the first embodiment and FIG. 12 shows a state where a damping part 70 in accordance with the seventh embodiment is detached from the double coil spring 30. In each of both end portions in the direction of length of the damping part 70, the middle portion 41 in the direction of width is protruded not only outside in the direction of length but also in the direction of thickness as compared with the side end portions 42, 43 on both sides in the direction of width.

Figure 13A:
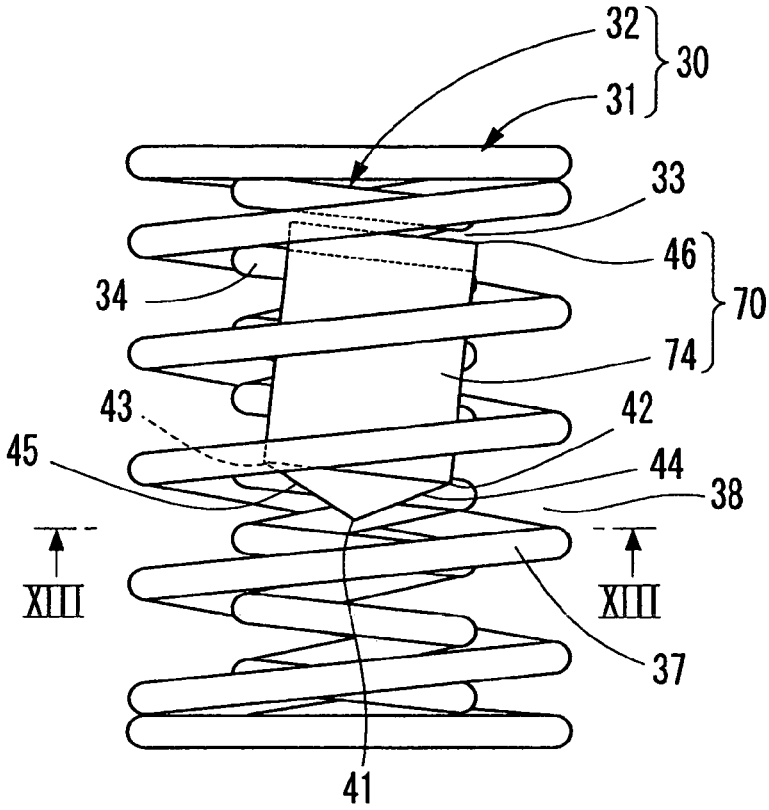
FIG. 13A is a front view of the damping part of the seventh embodiment attached to a double coil spring.
Figure 13B:
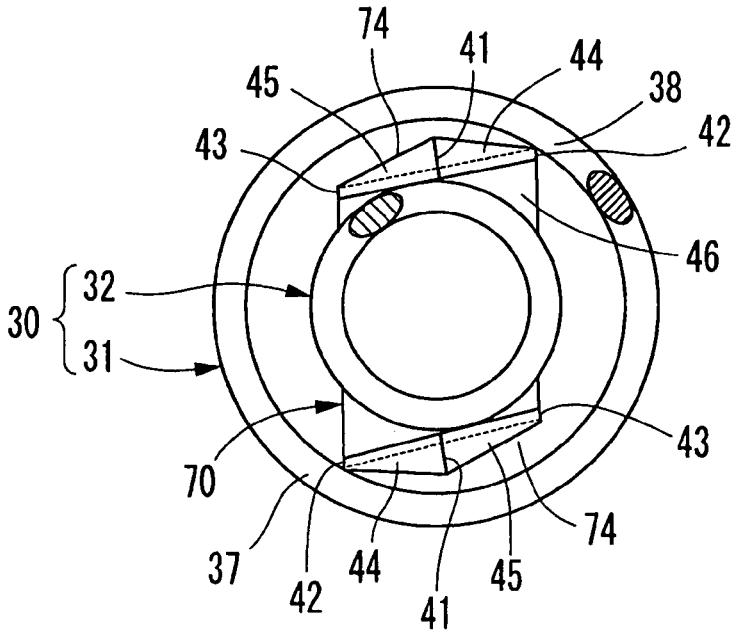
FIG. 13B is a cross-sectional view taken through line XIII-XIII of FIG. 13A.

When the damping part 70 like this is bent in the shape of a letter U as is the case with the first embodiment and is attached to the double coil spring 30, there is provided a state shown in FIG. 13. To be specific, in each of two inserting portions 74 constructed of both end portions of the damping part 70, the middle portion 41 in the direction of width is protruded toward the same one end of the double coil spring 30 and to the outside coil 31 as compared with both side end portions 42, 43 in the direction of width. Since the middle portion 41 is protruded to the outside coil 31 in this manner, in the state shown in FIG. 13 where the double coil spring 30 is most elongated, the side end portion 42 of each inserting portion 74 is hard to enter the gap 38 between the windings of the outside coil 31. With this, together with the same operation as in the first embodiment, it is possible to sufficiently prevent the side end portion 42 of each inserting portion 74 from abutting against the outside coil 31 in the gap 38 between the windings when the double coil spring 30 is compressed. Hence, it is possible to prevent the occurrence of abnormal noises and the deterioration of feeling of depressing the accelerator pedal with reliability.

Here, the distinctive construction of the seventh embodiment described above may be applied to the second to sixth embodiments described above.

Figure 14:
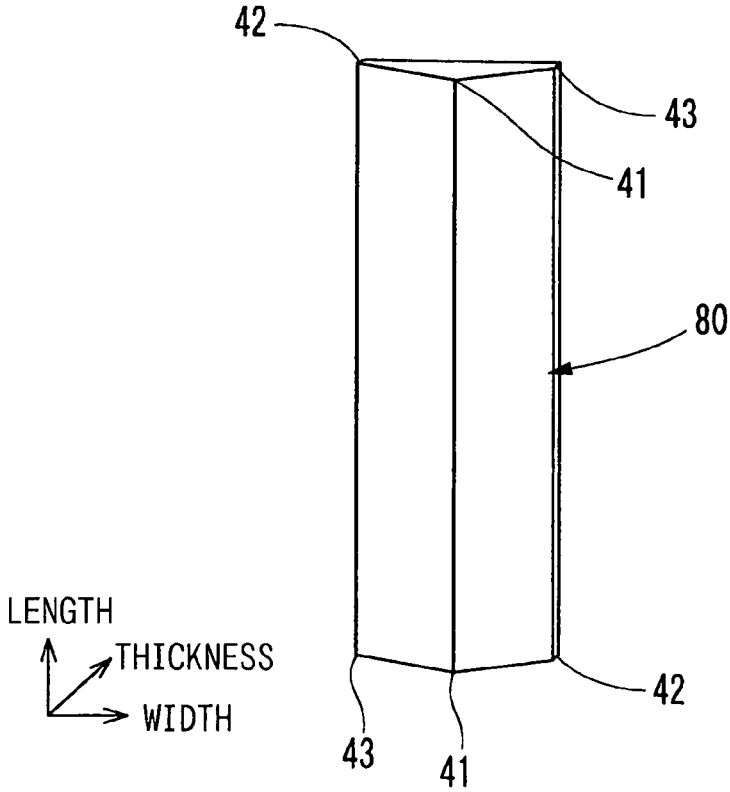
FIG. 14 is a perspective view of a damping part in accordance with an eighth embodiment of the present invention.

The eighth embodiment of the invention is a modification of the seventh embodiment and FIG. 14 shows a state where a damping part 80 in accordance with the eighth embodiment is detached from the double coil spring 30. In the whole damping part 80 including both end portions in the direction of length, the middle portion 41 in the direction of width is protruded in the direction of thickness as compared with the side end portions 42, 43 on both sides in the direction of width but is not protruded outside in the direction of length.

Figure 15A:
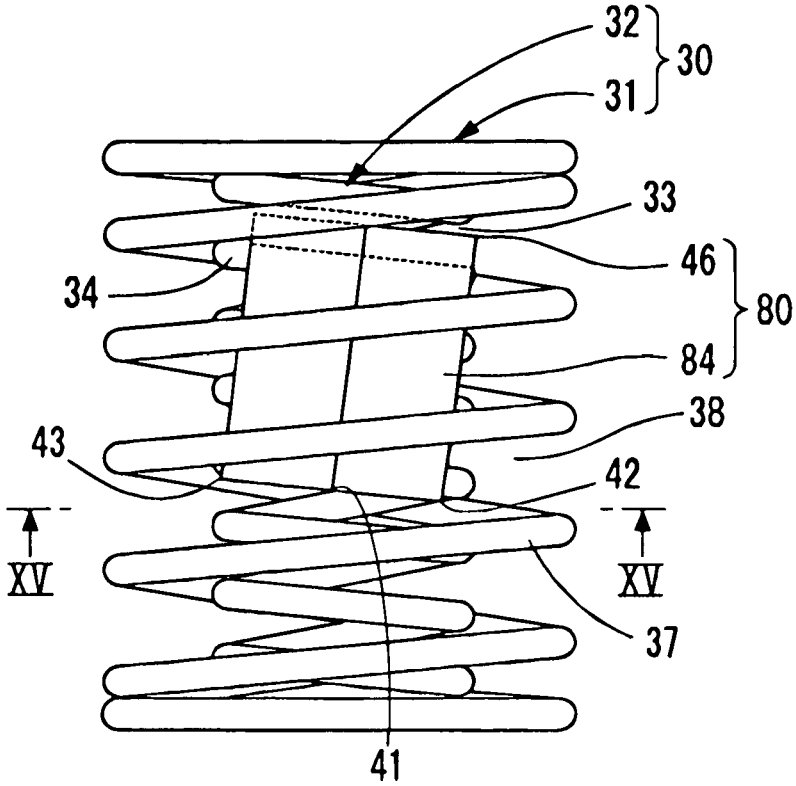
FIG. 15A is a front view of the damping part of the eighth embodiment attached to a double coil spring.
Figure 15B:
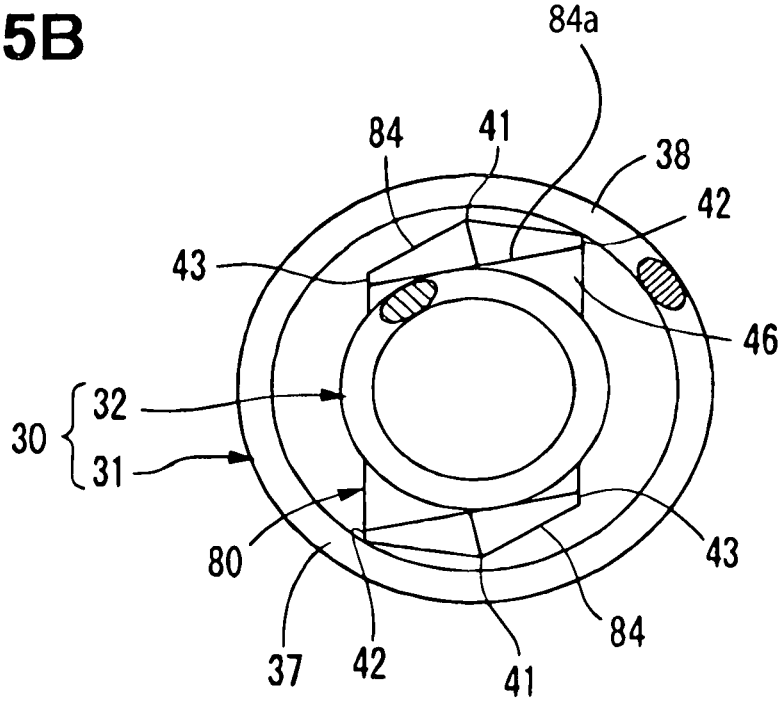
FIG. 15B is a cross-sectional view taken through line XV-XV of FIG. 15A.
Figure 16A:
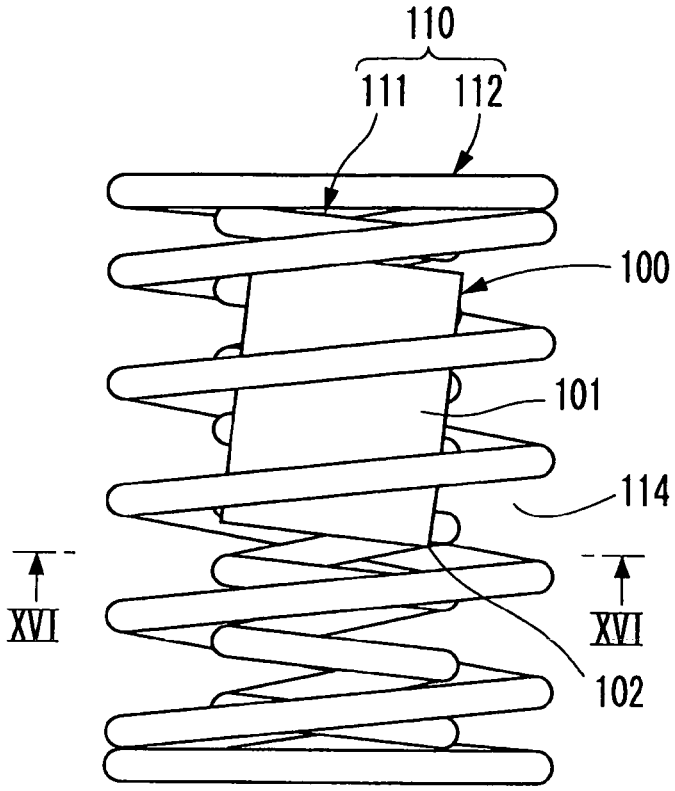
FIG. 16A PRIOR ART
FIG. 16A is a front view of a conventional damping part attached to a double coil spring.
Figure 16B:
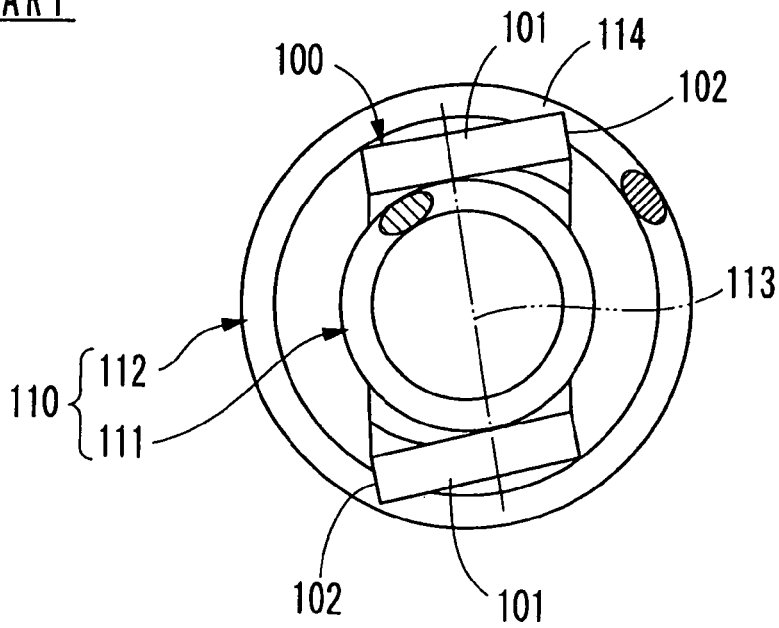
FIG. 16B PRIOR ART
FIG. 16B is a cross-sectional view taken through line XVI-XVI of FIG. 16A.
Figure 17A:
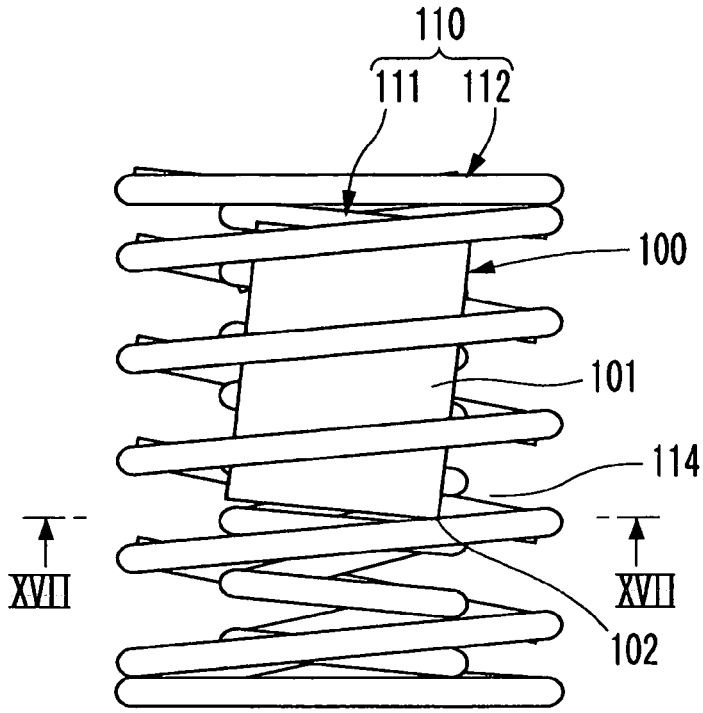
FIG. 17A PRIOR ART
FIG. 17A is a front view of the conventional damping part of FIG. 16 in a compressed state.
Figure 17B:
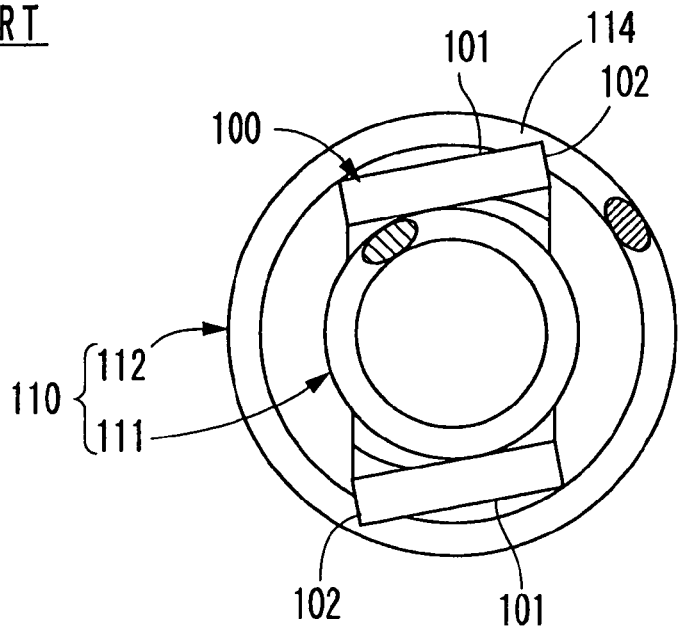
FIG. 17B PRIOR ART
FIG. 17B is a cross-sectional view taken through line XVII-XVII of FIG. 17A.

When the damping part 80 like this is bent in the shape of a letter U as is the case with the first embodiment and is attached to the double coil spring 30, there is provided a state shown in FIG. 15. To be specific, in each of two inserting portions 84 constructed of both end portions of the damping part 80, the middle portion 41 in the direction of width is protruded toward the outside coil 31 as compared with the side end portions 42, 43 in the direction of width. Further, each of the inserting portions 84 has a flat, planar radially inner surface 84*a* that is tangentially disposed with respect to the inside coil 32, the radial direction of the outside coil 31 is substantially perpendicular to the flat, planar radially inner surface 84*a* of the damping part 80 as shown in FIG. 15B. For this reason, in the state shown in FIG. 15 where the double coil spring 30 is most elongated, the side end portion 42 of each inserting portion 84 is hard to enter the gap 38 between the windings of the outside coil 31. With this, when the double coil spring 30 is compressed, it is possible to prevent the side end portion 42 of each inserting portion 84 from abutting against the outside coil 31 in the gap 38 between the windings and to prevent the side end portion 42 from detaching from the outside coil 31 after abutting to cause impact. Hence, it is possible to prevent the occurrence of abnormal noises and the deterioration of feeling of depressing the accelerator pedal.

While the plurality of preferred embodiments of the invention have been described above, it should not be understood that the invention is limited to the plurality of preferred embodiments.

For example, in the plurality of preferred embodiments is used one damping part of the type in which two inserting portions are connected to each other by the retaining portion. In contrast to this, it is also recommended to use two or more damping parts of the type in which two inserting portions are connected to each other by a retaining portion. Alternatively, it is also recommended to use a suitable number of damping parts of the type in which one inserting portion is connected to one retaining portion. Further, alternatively, it is also recommended to use a suitable number of damping parts having only an inserting portion, that is, damping parts that are not retained by the inside coil.

Further, in the embodiments described above, the middle portion located in the center in the direction of width is protruded as a middle portion in the direction of width of the inserting portion as compared with the side end portions on both sides in the direction of width, but it is also recommended that a middle portion shifted from the center in the direction of width of the inserting portion be protruded. Further, in any case, it is also possible to protrude a middle portion (center portion) in the direction of width with respect to only one side end portion in the direction of width.

Still further, in the plurality of embodiments described above, the double coil spring of a combination of two compression coil springs is used, but a double coil spring of a combination of two tension coil springs may be used. In any case, the outside coil and the inside coil may be wound in the same direction or in the opposite directions. Further, a suitable number of other coil springs may be further arranged inside the inside coil or outside the outside coil.

In addition, in the plurality of embodiments described above, examples have been described in which the invention is applied to the accelerator for a vehicle. However, the invention can be applied to a publicly known pedal module provided with a pedal that is turned in the forward direction by the operation of depressing force and is turned in the reverse direction by the operation of restoring force of the double coil spring.

What is claimed is:

1. A pedal module comprising:

a double coil spring that includes an outside coil and an inside coil, wherein the inside coil is placed inward of the outside coil in a radial direction of the outside coil;

a pedal that turns in a forward direction when an external depressing force is applied thereto, wherein the pedal turns in a reverse direction, which is opposite from the forward direction, when a restoring force of the double coil spring is applied thereto; and a damping part that is made of an elastic material and has an inserting portion, which is disposed between the outside coil and the inside coil in the radial direction of the outside coil, wherein:

the inserting portion includes a first side end portion, a slant surface portion, and a middle portion, which are arranged one after another in a direction of width;

the middle portion protrudes axially away from the first side end portion in a direction of length of the inserting portion, toward an axial end of the outside coil, for preventing the occurrence of abnormal noises and the deterioration of feeling of depressing the pedal;

the slant surface portion has a flat planar surface, which is generally flat in a state where the external depressing force is not applied to the pedal;

the flat planar surface of the slant surface portion is configured to abut against and to be radially inwardly guided along one of a plurality of windings of the outside coil, and deflected radially inward by the one of the plurality of windings to a location radially inward of the outside coil, when the pedal is turned in the forward direction to compress the outside coil and the inside coil; and an angle θ1, which is defined between the flat planar surface of the slant surface portion and the direction of width of the inserting portion that is perpendicular to the direction of length of the inserting portion, is larger than an angle θ2, which is defined between the one of the plurality of windings of the outside coil and an imaginary line that is parallel to the direction of width of the inserting portion, in the state where the external depressing force is not applied to the pedal.

2. The pedal module as claimed in claim 1, wherein the inserting portion further includes a second side end portion that is disposed opposite the middle portion from the first side end portion and wherein the middle portion protrudes beyond the second side end portion toward the axial end of the outside coil.

3. The pedal module as claimed in claim 2, wherein the middle portion protrudes radially beyond the second side end portion toward the outside coil.

4. The pedal module as claimed in claim 1, wherein the middle portion protrudes radially beyond the first side end portion toward the outside coil.

5. The pedal module as claimed in claim 1, wherein:

the damping part is a first damping part and the inserting portion is a first inserting portion; and further comprising a second damping part having a second inserting portion, which is identical to the first inserting portion, wherein the second inserting portion is radially disposed between the outside coil and the inside coil and is diametrically opposed to the first inserting portion; and the first inserting portion and the second inserting portion are connected together by a retaining portion, which is retained in a gap between windings of the inside coil.

6. The pedal module as claimed in claim 1, wherein the pedal is used as an accelerator for a vehicle in which the pedal is an accelerator pedal.

7. The pedal module as claimed in claim 1, wherein the damping part has a flat, planar radially inner surface that is tangentially disposed with respect to the inside coil, said radial direction of the outside coil being substantially perpendicular to said flat, planar radially inner surface of said damping part.

8. A pedal module comprising:

a double coil spring that includes an outside coil and an inside coil, wherein the inside coil is placed inward of the outside coil in a radial direction of the outside coil;

a pedal that turns in a forward direction when a depressing force is applied thereto and turns in a reverse direction when a restoring force of the double coil spring is applied thereto; and a damping part that is made of an elastic material and has an inserting portion, said damping part being disposed entirely between the outside coil and the inside coil in the radial direction of the outside coil, wherein:

the inserting portion includes a first side end portion and a middle portion, which are arranged one after another in a direction of width;

the middle portion protrudes outwardly away from the first side end portion in the radial direction of the outside coil toward the outside coil, for preventing the occurrence of abnormal noises and the deterioration of feeling of depressing the pedal; and the damping part has a flat, planar radially inner surface that is tangentially disposed with respect to the inside coil, said radial direction of the outside coil being substantially perpendicular to said flat, planar radially inner surface of said damping part.

9. The pedal module as claimed in claim 8, wherein the inserting portion further includes a second side end portion that is disposed opposite the middle portion from the first side end portion and wherein the middle portion protrudes radially beyond the second side end portion toward the outside coil.

10. The pedal module as claimed in claim 8, wherein:

the damping part is a first damping part and the inserting portion is a first inserting portion; and further comprising a second damping part having a second inserting portion, which is identical to the first inserting portion, wherein the second inserting portion is radially disposed between the outside coil and the inside coil and is diametrically opposed to the first inserting portion; and the first inserting portion and the second inserting portion are connected together by a retaining portion, which is retained in a gap between windings of the inside coil.

11. The pedal module as claimed in claim 8, wherein the pedal is used as an accelerator for a vehicle in which the pedal is an accelerator pedal.

12. A pedal module comprising:

a double coil spring that includes an outside coil and an inside coil, wherein the inside coil is placed inward of the outside coil in a radial direction of the outside coil;

a pedal that turns in a forward direction when a depressing force is applied thereto and turns in a reverse direction when a restoring force of the double coil spring is applied thereto; and a damping part that is made of an elastic material and has an inserting portion, said damping part being disposed entirely between the outside coil and the inside coil in the radial direction of the outside coil, wherein:

the inserting portion includes a first side end portion and a middle portion, which are arranged one after another in a direction of width, the middle portion protrudes axially away from the first side end portion in a direction of length, toward an axial end of the outside coil, for preventing the occurrence of abnormal noises and the deterioration of feeling of depressing the pedal, and the damping part has a flat, planar radially inner surface that is tangentially disposed with respect to the inside coil, said radial direction of the outside coil being substantially perpendicular to said flat, planar radially inner surface of said damping part.

13. The pedal module as claimed in claim 12, wherein the inserting portion further includes a second side end portion that is disposed opposite the middle portion from the first side end portion and wherein the middle portion protrudes beyond the second side end portion toward the axial end of the outside coil.

14. The pedal module as claimed in claim 12, wherein the middle portion protrudes radially beyond the second side end portion toward the outside coil.

15. The pedal module as claimed in claim 12, wherein the middle portion protrudes radially beyond the second side end portion toward the outside coil.

16. The pedal module as claimed in claim 12, wherein:

the damping part is a first damping part and the inserting portion is a first inserting portion; and further comprising a second damping part having a second inserting portion, which is identical to the first inserting portion, wherein the second inserting portion is radially disposed between the outside coil and the inside coil and is diametrically opposed to the first inserting portion; and the first inserting portion and the second inserting portion are connected together by a retaining portion, which is retained in a gap between windings of the inside coil.

17. The pedal module as claimed in claim 12, wherein the pedal is used as an accelerator for a vehicle in which the pedal is an accelerator pedal.

* * * * *